US005456391A

United States Patent [19]

Chang

[11] Patent Number: 5,456,391

[45] Date of Patent: Oct. 10, 1995

[54] SUIT HANGER WITH ADJUSTABLE SHOULDERS

[76] Inventor: John Chang, No. 1-2, Lane 975, Chun-Jih Road, Tao-Yuan City, Taiwan

[21] Appl. No.: 329,873

[22] Filed: Oct. 27, 1994

[51] Int. Cl.[6] ..... A47G 25/44

[52] U.S. Cl. ..... 223/94; 223/89

[58] Field of Search ..... 223/94, 89, 92, 223/85, 88, 95; 211/113

[56] References Cited

U.S. PATENT DOCUMENTS 2,926,823 3/1960 Weiser ..... 223/94

2,944,711 7/1960 Sage ..... 223/94

3,874,572 4/1975 McClenning ..... 223/94

5,044,535 9/1991 Hunt ..... 223/89

*Primary Examiner*—C. D. Crowder

*Assistant Examiner*—Bibhu Mohanty

*Attorney, Agent, or Firm*—Morton J. Rosenberg; David I. Klein

[57] ABSTRACT

A suit hanger with adjustable shoulder members includes a main frame, an actuating assembly and a slidable shoulder members. By the action of the actuating assembly, the slidable shoulder can be extended to a full length to increase the width of the suit hanger or be fully retracted to decrease the width of the suit hanger. In light of this, the suit hanger can be readily adjusted to meet different requirements.

2 Claims, 9 Drawing Sheets

2b

SUIT HANGER WITH ADJUSTABLE SHOULDERS

BACKGROUND OF THE INVENTION

This invention relates to a suit hanger, more particularly, to a suit hanger with adjustable shoulders arm to support different suit.

As shown in FIGS. 10A and 10B, the conventional suit hanger is made directly from curved metal wire or it may carved from wood or directly molded from plastic material. No matter which material is applied to make the conventional suit hanger, its has a fixed shape, i.e. it has a fixed size. For example, the suit hanger shown in FIG. 10A has a larger size as compared with the suit hanger shown in FIG. 10B. Accordingly, each kind of suit hanger has its designated usage, it can not be utilized to the suit which is too larger or small to it.

In fact, the suit may have many a sizes and it is impossible for the user to prepare many a suit hangers for different suits or other cloth. As a matter of fact, the suit hanger now available in the market has only two sizes, as shown in FIG. 10A and 10B. This really brings an inconvenience to the user since if a suit is too large for small suit hanger (b), the suit or cloth may fall down without the help of a clothespin. On the country, if the suit hanger (a) is too large to a suit or cloth, the suit or cloth may be expanded and deformed after a long period of usage.

U.S. Pat. No. 5,082,152 has disclosed a suit hanger which is designed to solve the problems which the conventional suit hangers, as shown in FIG. 10A and 10B. The improvement resides on which provides a telescopic shoulder members c2 to arrange different width to meet different usage, i.e. different suit or cloth. This is really a good idea since only one kind of suit hanger can meet different suits. Even this suit hanger is now available in the market, it can be concluded with the following defects according to the user response.

1. The shoulder members c2 shall be adjusted individually from both ends, accordingly, the left and right shoulder member may have different length which results in an unbalanced posture for hanging the suit or cloth. Besides, the suit or cloth tends to deform in this position. For those precious cloths or suits, this shall never happen.

2. When the shoulder member c2 are pulled outward, there is any fastening mean to position it in a desired position, accordingly, the shoulder members are readily retracted as pushed by the suit or cloth from both ends. In light of this, the suit or cloth tends to deform and the suit or cloth tends to fall off as the width of the shoulder members decrease.

3. When the shoulder member c2 is pulled out, the supporting rod c3 is not pulled out synchronously, the more the shoulder member extends, the less support receives from the supporting rod c3. As a result, the less weight it sustains.

SUMMARY OF THE INVENTION

It is the object of this invention to provide a suit hanger with adjustable shoulder to meet different suit or cloth.

According to one aspect of this invention, the left shoulder and the right shoulder are interconnected by an actuating knob. When the actuating knob is rotated by hand, the left shoulder and right shoulder are pulled our or retracted simultaneously and synchronously to keep an equal length among those two shoulder members.

According to another aspect of this invention, the suit hanger is provided with a positioning means to hold on the shoulder member in a desired position.

According to another aspect of this invention, when the shoulder members are pulled out from both sides, the supporting rods are pulled out simultaneously to support the cloth.

BRIEF DESCRIPTION OF THE DRAWINGS

The objects and other advantages of the present invention will become more apparently as in conjunction with a preferred embodiment and drawings accompanied thereof; wherein.

DETAILED DESCRIPTION OF PREFERRED EMBODIMENT

Figure 1:
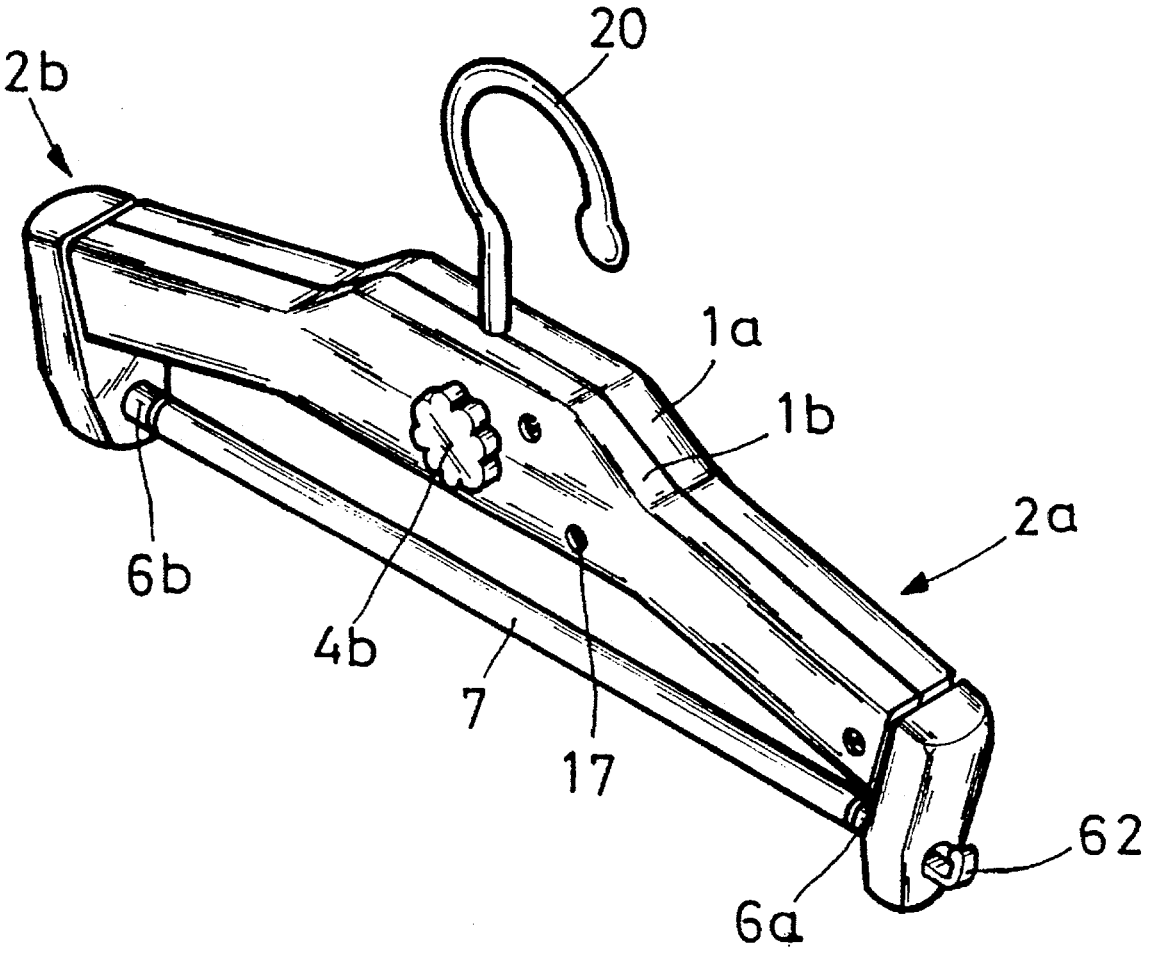
FIG. 1 is a perspective view of the suit hanger made according to this invention.

Referring to FIGS. 1 to 5, the suit hanger with adjustable shoulder generally includes a main frame 1*a*, 1*b* which have the identical configuration. As clearly shown in FIGS. 2 and 3, a hole 11 is disposed at the central portion. The underside of the hole 11 has an enlarged portion 12. A central hole 13 is disposed at the front and rear portion of the main frame 1*a*, 1*b* respectively. A sliding slot 14 is provided at the inner wall of the main frame 1*a*, 1*b* which extends to a preset distance. The inner wall of the slot 14 is provided with a slot 15. A guiding slot 18 is disposed between two adjacent slots 15. One of the main frame 1*a*, 1*b* is provided with a plurality of posts 16*a*. Each of the post 16*a* is provided with a through hole 161. The cross main frame 1*a* or 1*b* is provided with a dowel hole 16*b* for receiving the post 16*a* when the two main frame 1*a*, 1*b* are attached together. The bottom side of the dowel hole 16*b* is provided with threaded hole 162 for receiving a screw 17 to attach the main frame 1*a*, 1*b* with each other.

A swivel hook 20 which has an enlarged boss 200 is retained in the larger space 12 of the hole 11.

Figure 2:
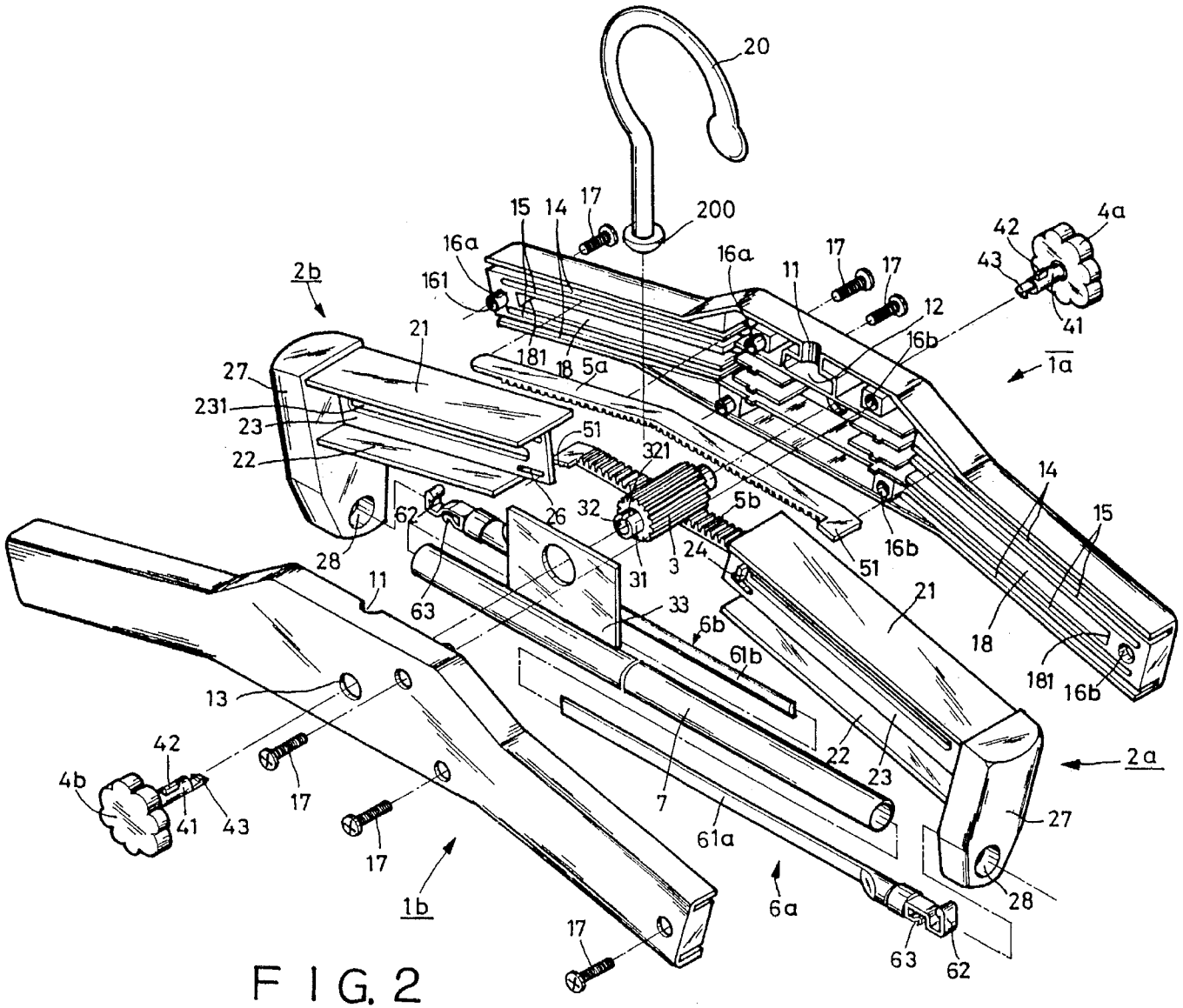
FIG. 2 is an exploded perspective view of the suit hanger made according to this invention.
Figures 3A, 3B, 3C, 3D, 3E:
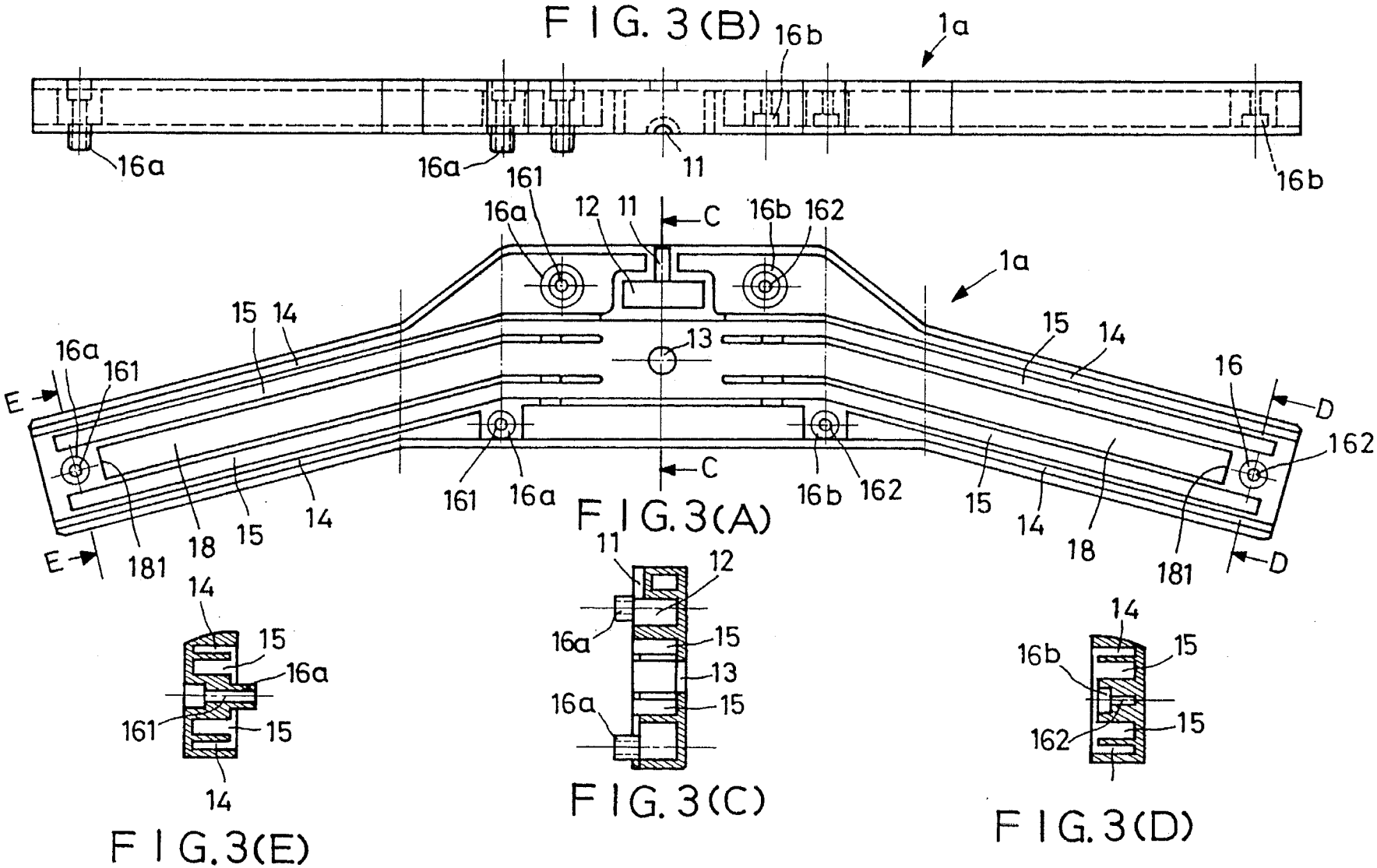
FIG. 3 is a detailed view of the frame of the suit hanger made according to this invention.
Figure 4:
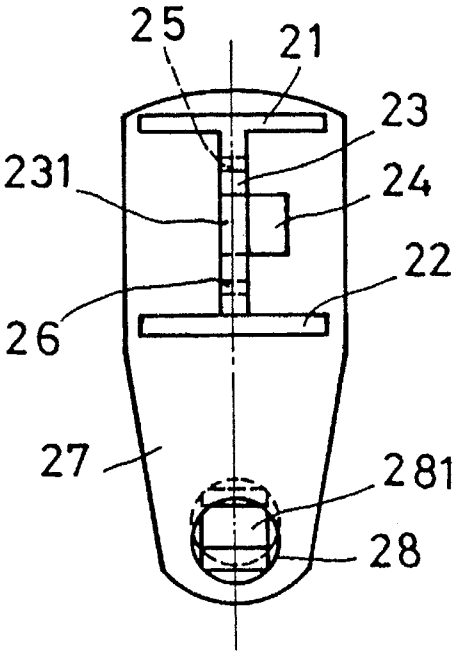
FIG. 4 is a detailed view of the shoulder member of the suit hanger made according to this invention.
Figure 4:
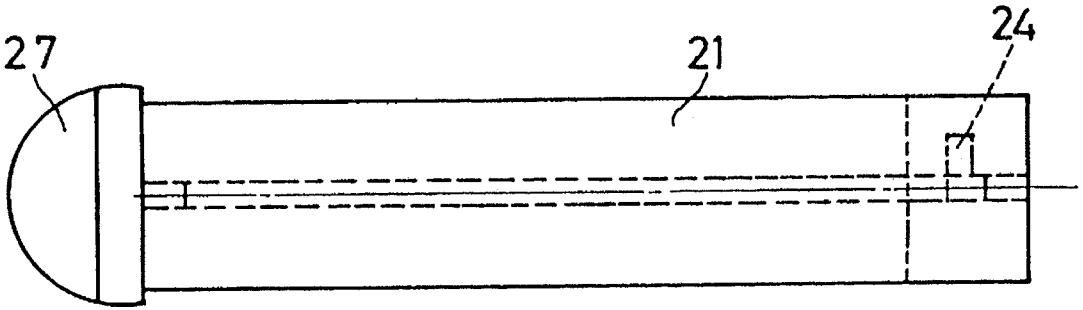
Figure 4:
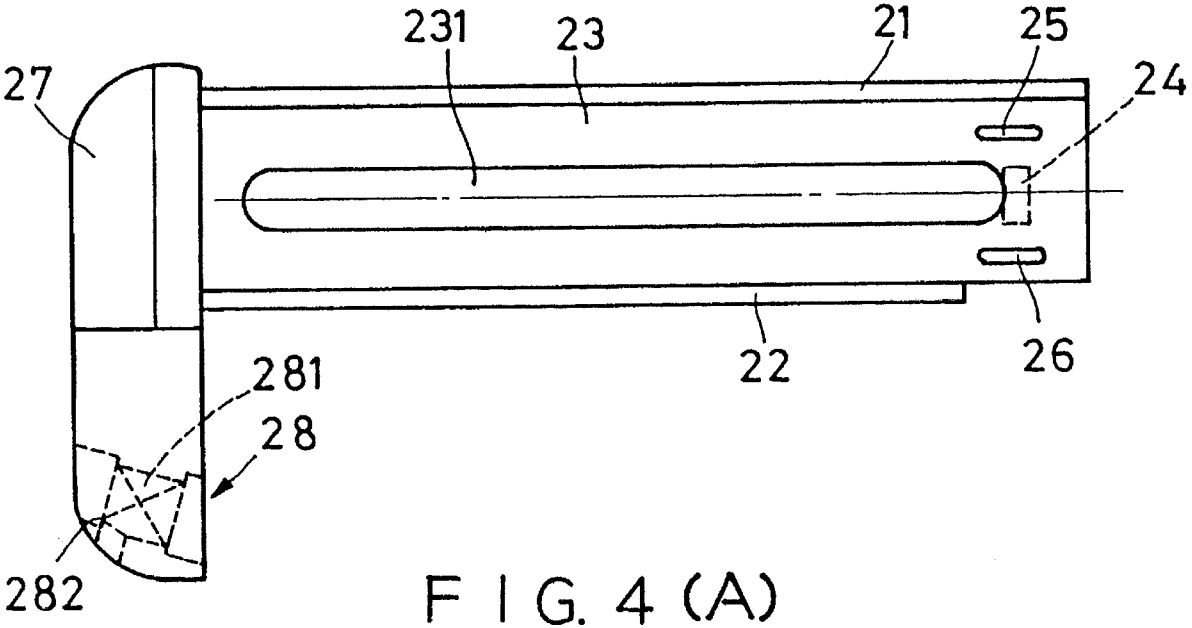

A pair of shoulder members 2*a*, 2*b* which has an identical configuration with each other. As shown in FIGS. 2 and 4, the shoulder member 2*a*, 2*b* has an "T" shape cross section. The upper and lower plates 21, 22 are slidable within the sliding slots 14 of the main frame 1*a*, 1*b*. A connecting plate 23 is interconnected between the upper and lower plates 21, 22. A guiding hole 231 is disposed at the central portion of the connecting plate 23. A stopper 24 is disposed at the inner side of the guiding hole 231. Two connecting holes 25 and 26 are at the connecting plate 23. The side of the shoulder member 2*a*, 2*b* is connected with a side shoulder 27 which extends downward and outward. A connecting hole 28 is disposed at the bottom end of the side shoulder 27. The connecting hole 28 has a rectangular slot 281 at the middle portion. A retaining portion 282 is provided at the side of the rectangular slot 281.

A gear 3 is disposed between the main frame 1*a*, 1*b* by means of the shaft 31 which is rotably bridged between the central hole 13. The shaft 31 has a passage 32 lengthwise. A key slot 321 is provided at the passage 32. A positioning tab 282 is provided at the peripheral.

A pair of adjusting knobs 4*a*, 4*b* which has an identical configuration with each other. The shaft 41 of the adjusting knobs 4*a*(4*b*) has a rectangular key 42 having a hooker 43 at front portion. The shaft 41 of the knob 4*a*(4*b*) is received and retained within the passage 32 of the gear 3.

A pair of rack 5*a*, 5*b* which has an identical configuration are meshed with the gear 3 at upper and lower side. One end of the rack 5*a*(5*b*) has a connecting block 51 which can be received and retained within the connecting holes 25, 26 of the shoulder members 2*a*, 2*b*. Each of the two rack 5*a*, 5*b* is slidably within two adjacent slots 15.

Figure 5:
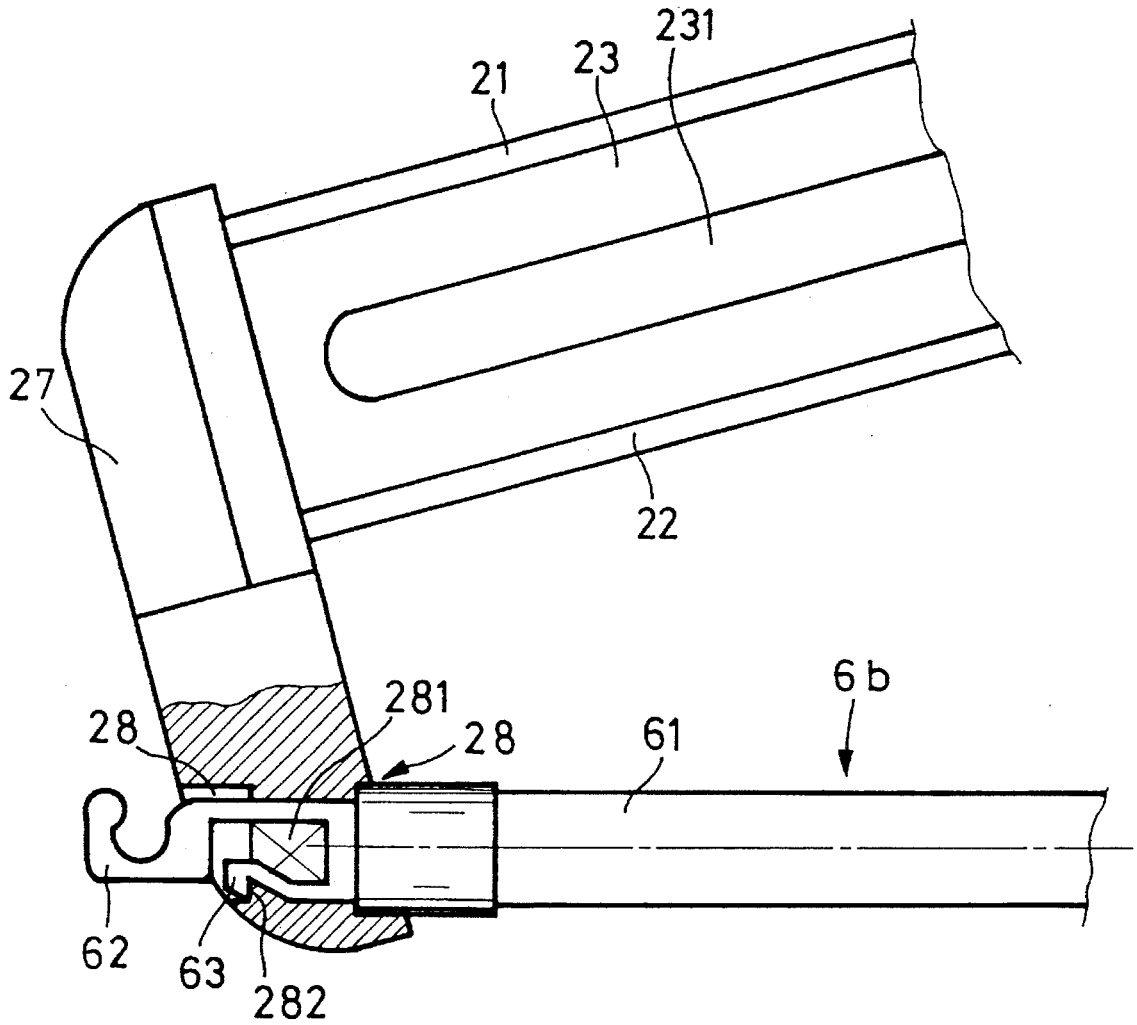
FIG. 5 is a cross sectional view showing the connection between the shoulder and the supporting rod.

A pair of crossbars 6*a*, 6*b* which has an identical configuration are bridged between the shoulder member 2*a*, 2*b*. Each of the crossbar 6*a*, 6*b* is defined by a rod 61 which has a flat arc cross section. When two crossbar 6*a*, 6*b* are jointed together, a rod is formed. The end of the crossbar 6*a*, 6*b* is provided with a hooker 62 respectively. The inner underside of the crossbar 6*a* (6*b*) is formed with a retaining hooker 63, as shown in FIG. 5, to be received and retained by the retaining portion 282 of the connecting hole 28.

A tube 7 is used to enclose the crossbar 6*a* and 6*b*.

By the assembling of the elements described above, a suit hanger with adjustable shoulder member is constructed.

Figure 6A:
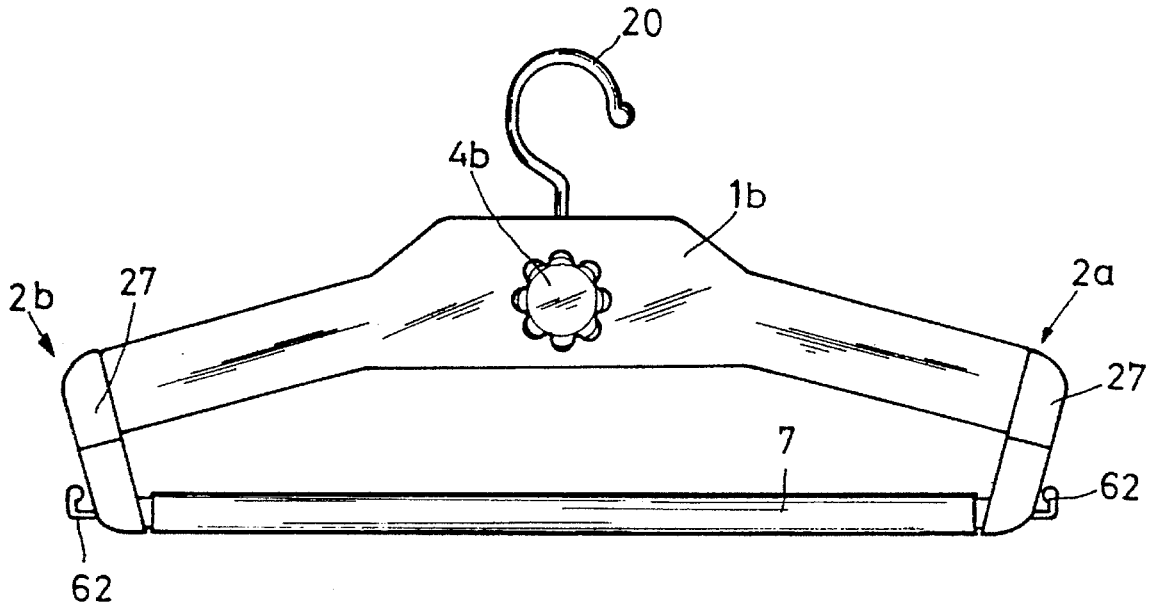
FIG. 6A is a sketch view showing the suit hanger in a retracted position.
Figure 6B:
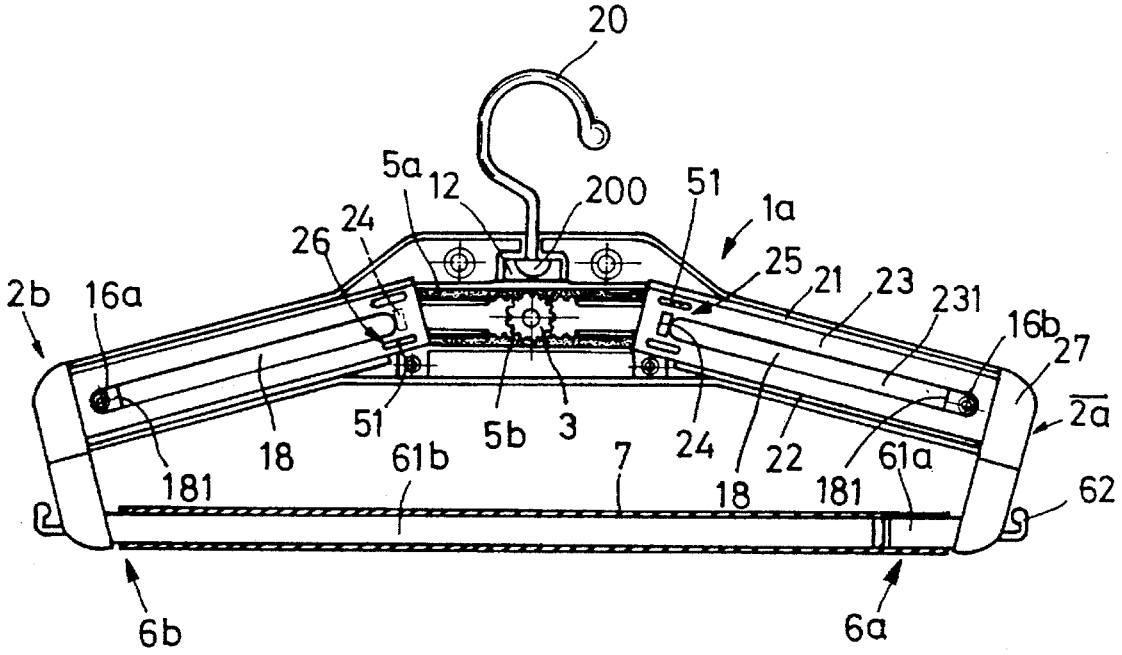
FIG. 6B is a cross sectional view of the supporting rod and the sleeve.
Figure 7A:
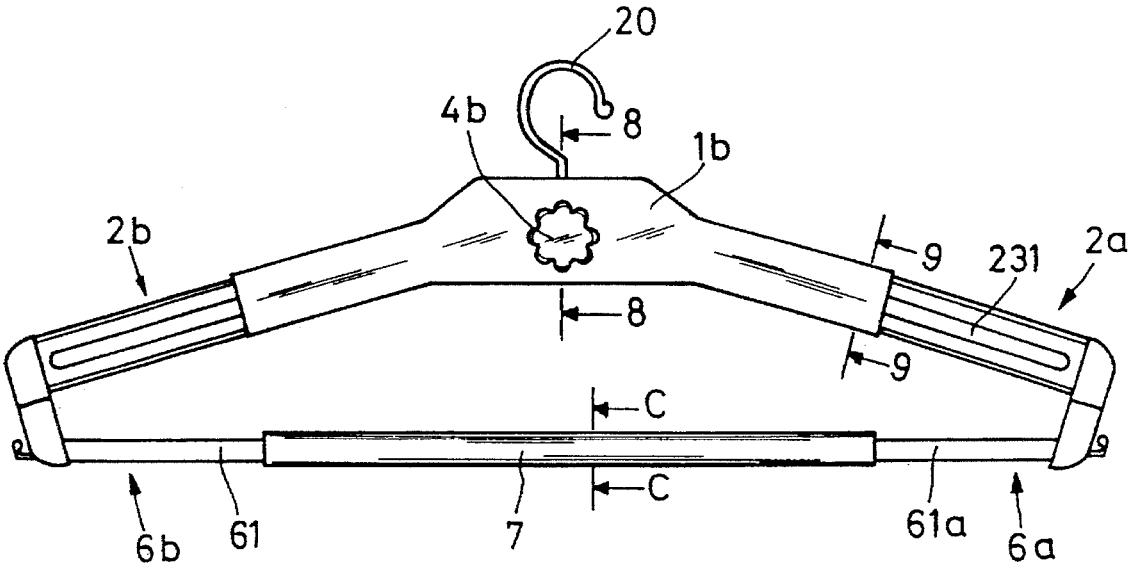
FIG. 7A is a sketch view showing the suit hanger in a extended position.

As clearly shown in FIG. 6, the suit hanger made according to this invention is in a retracted position, i.e. the shoulder members 2*a*, 2*b* are retracted within the sliding slot 14 of the main frame 1*a* and 1*b*. The connecting block 51 of the upper rack 5*a* is fixed at the connecting hole 25 of the right shoulder member 2*a* and the lower rack 5*b* is fixed at the connecting hole 26 of the left shoulder member 2*b*. The upper and lower rack 5*a*, 5*b* are meshed with the gear 3. By this arrangement, when one of the adjusting knob 4*a*, 4*b* is rotated, the gear 3 is rotated accordingly, as a result, the rack 5*a* and 5*b* are moved within the slot 15 and away each other synchronously. Since the rack 5*a*, 5*b* are made from nylon, it is flexible to bend within the slot 15 to conform to its slope. At last, the lower and upper plates 21, 22 of the shoulder members 2*a*, 2*b* are moved away from each other within the sliding slot 14. As shown in FIGS. 7A, 7*b*, when the adjusting knob 4*b* rotates to its limit along the clockwise direction, the shoulder member 2*a*, 2*b* are pushed to the outmost position by the help of the upper and lower racks 51*a*, 51*b*, meanwhile, the stopper 24 within the guiding hole 231 is abutted with the end face 181 of the slot 18. In the position, the suit hanger has the largest width as the shoulder members 2*a*, 2*b* are fully extended.

When the adjusting knob 4*b* is rotated counterclockwise, then the rack 5*a*, 5*b* are moved close to each other by the rotation of the adjusting knob 4*b*, consequently, the shoulder members 2*a* and 2*b* are fully retracted, as shown in FIG. 6. In this position, the suit hanger has the narrowest width.

It can be easily appreciated that the width of the suit hanger can be readily adjusted to meet different requirements. Only by rotating the adjusting knob 4*a*, 4*b*, the width can be readily adjusted.

Figure 7C:
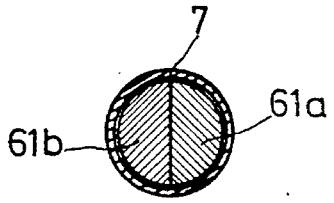
FIG. 7C is a cross sectional view of the supporting rod and the sleeve.
Figure 7B:
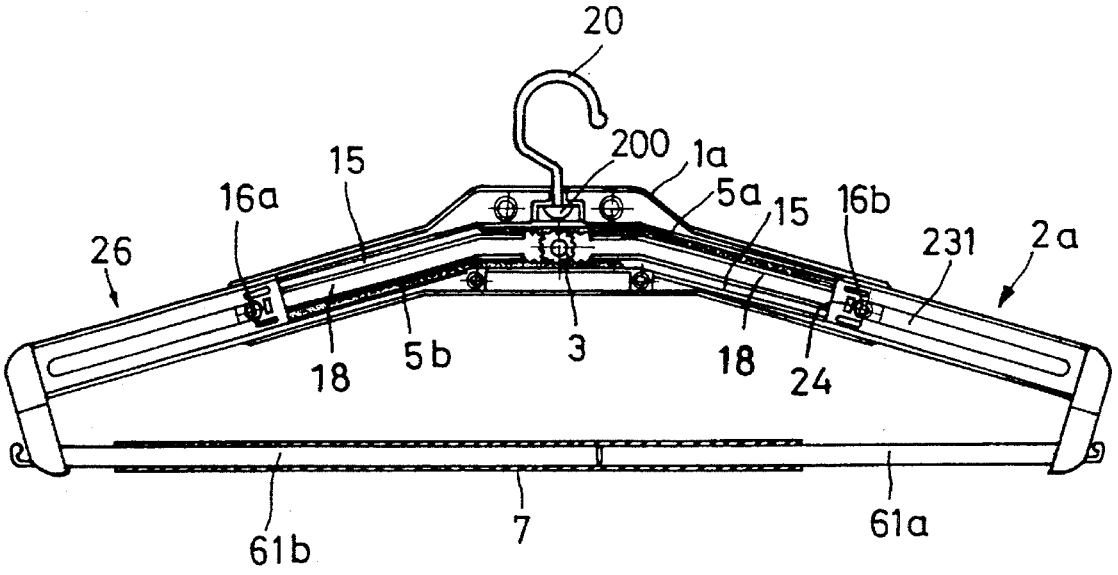
FIG. 7B is a detailed view showing the detailed configuration when the suit hanger in the position in FIG. 7A.

As shown in FIG. 7C, when the shoulder members 2*a*, 2*b* are fully extended or retracted, the crossbar 6*a*, 6*b* are extended and retracted accordingly. Because the crossbars 61*a*, 61*b* are moved away or close to each other within the sleeve 7, the crossbars 61*a*, 61*b* can be retained in a horizontal position.

Figure 8:
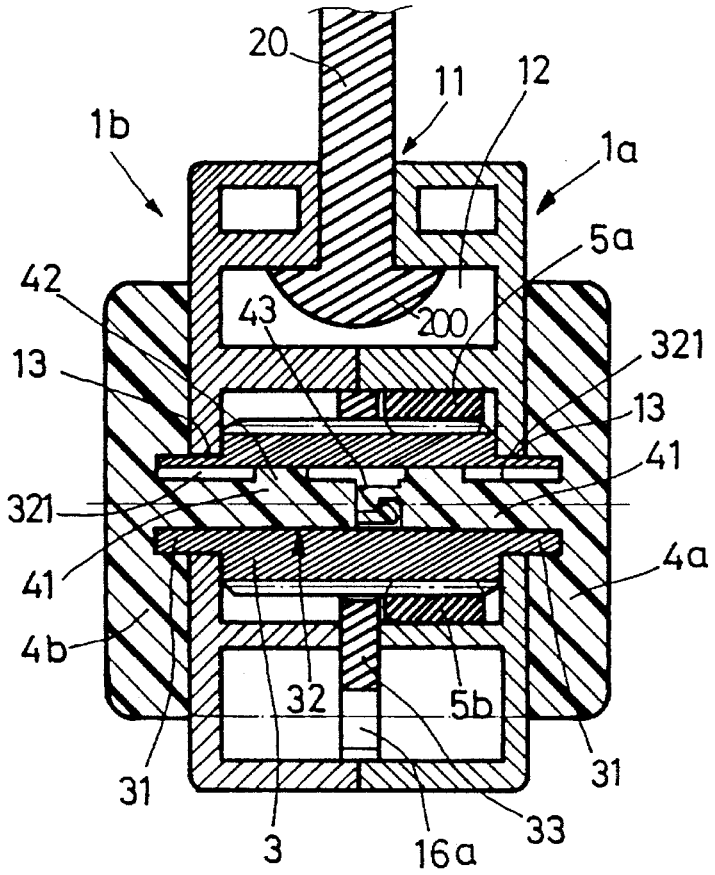
FIG. 8 is a cross sectional view of the suit hanger taker from line 8—8 in FIG. 7.

Referring to FIG. 8, the cross sectional view of the suit hanger. When the main frame 1*a*, 1*b* are assembled, the boss 200 of the swivel hooker 20 is received and retained within the space 12. By this arrangement, the swivel hooker 20 can rotate through 360 degrees. The gear 3 is bridged between central hole 13 of the main frame 1*a*, 1*b* by the help of the shaft 31. The adjusting knobs 4*a*, 4*b* is fixed to the gear 3 by inserting its shaft 41 into the passage 32 of the shaft 31 of the gear 3. Besides, the rectangular key 42 is linked with the key slot 321 within the passage 32. By this arrangement, the gear 3 can be easily rotated by rotating the adjusting knob 4*a*, 4*b*. In order to prevent the adjusting knob 4*a*, 4*b* from breakout, the hookers 43 located at front of the shaft 41 are interlocked with each other. Accordingly, when one of the adjusting knob 4*a*, 4*b* is rotated, the gear 3 is rotated accordingly. Consequently, the racks 5*a*, 5*b* are moved accordingly. Besides, a positioning tab 33 is disposed adjacent to the gear 3. The positioning tab 33 is bridged between the main frame 1*a*, 1*b*.

Figure 9:
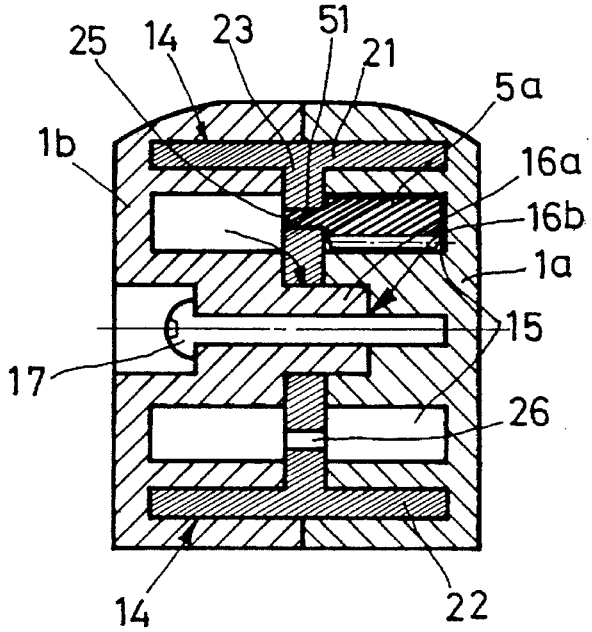
FIG. 9 is a cross sectional view of the suit hanger taker from line 9—9 in FIG. 7.

Referring to FIG. 9, a cross sectional view of the shoulder member 2*a* within the main frame 1*a*, 1*b*. When the main frame 1*a*, 1*b* are assembled, the post 16*a* of the main frame 1*a* is received by the dowel hole 16*b* of main frame 1*b*. Afterward, a screw 17 is applied to lock the two. The sliding slot 14 is provided for the movement of the upper and lower plates 21, 22. the guiding slot 231 of the connecting plate 23 is movable along the post 16*a*. The upper rack 5*a* is fixed to the connecting plate 23 by the connection between the connecting block 51 and the connecting hole 25. As a result, the shoulder member 2*a* is moved accordingly. The shoulder member 2*b* is moved by the rack 5*b* by the same principle.

The invention can be concluded with the following advantages.

Figure 10:
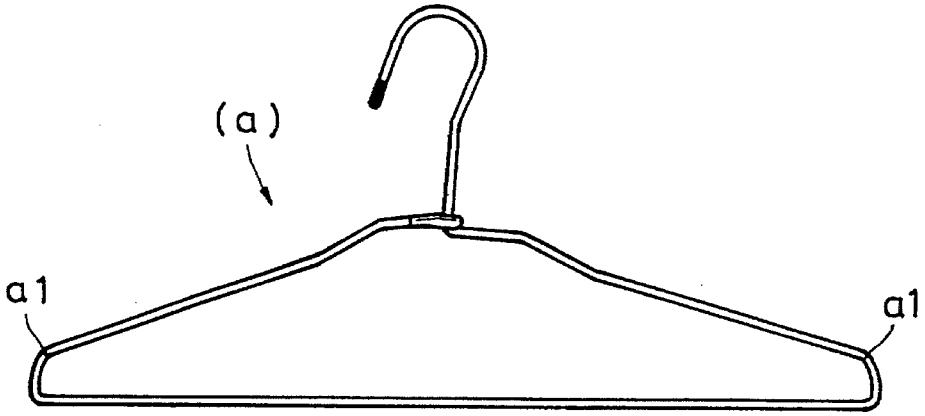
PRIOR ART FIG. 10 (A)
FIG. 10A, B and C are the sketch view of the conventional suit hanger.
Figure 10:
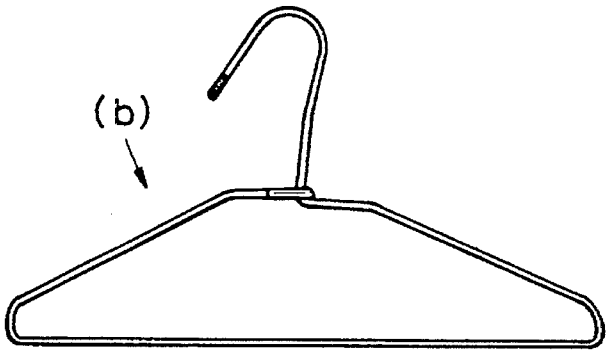
PRIOR ART FIG. 10 (B)
Figure 10:
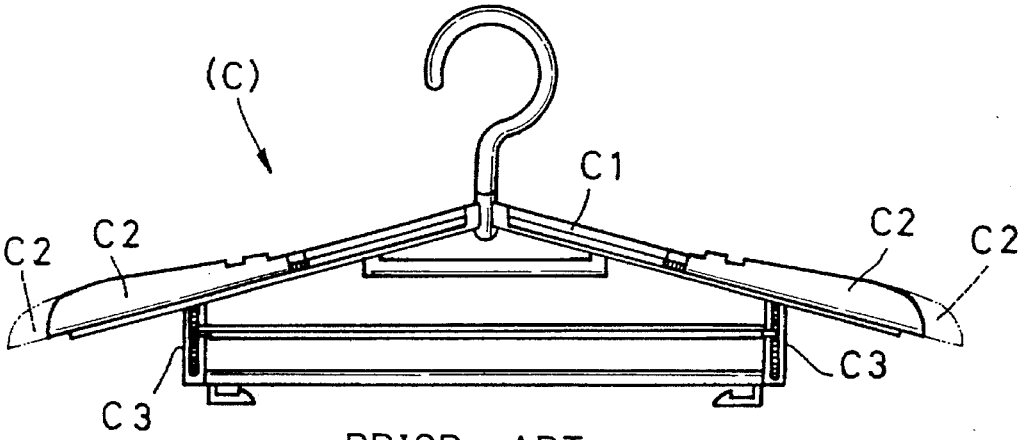
PRIOR ART FIG. 10 (C)

1. The width of the shoulder member can be readily adjusted to meet different requirements. The suit hanger made according to this invention is superior than the suit hanger disclosed in FIGS. 10A, 10B.

2. Then width of the shoulder members can be readily adjusted by rotating the adjusting knob 4*a* (4*b*) or pulling out or in of the shoulder member 2*a* (2*b*). Accordingly, the shoulder member may remain in an equal length.

3. The shoulder members can be positioned in a desired position without retracting as it shoulders the weight of the suit or cloth. Since the racks are meshed with the gear 3 and the racks have a certain slope, unless the adjusting knob is rotated or the shoulder member is pulled in, the shoulder member will be kept in its desired position.

4. When the shoulder members 2*a*, 2*b* are pulled out, the side shoulder member 27 and the crossbars 6*a*, 6*b* are extended as well. Accordingly, the shoulder member has a good support to sustain the weight of the suit or the cloth. In light of this, the suit hanger made according to this invention is superior than the suit hanger disclosed in U.S. Pat. No. 5,082,152.

5. The main frame 1*a*, 1*b*, the shoulder member 2*a*, 2*b*, the adjusting knob 4*a*, 4*b*, the rack 5*a*, 5*b* and the crossbar 6*a*, 6*b* are identical with each other, accordingly, the manufacturing cost can be lowered to a certain amount.

I claim:

1. A suit hanger with adjustable shoulders comprising:

a pair of main frames having a hole being disposed at the central portion, the underside of said hole having an enlarged portion, a central hole being disposed at a front and rear portion of said main frames respectively, a sliding slot being provided at the inner wall of said main frame which extends to a preset distance, the inner wall of said sliding slot being provided with a slot, a guiding slot being disposed between two adjacent slots, one of said main frames being provided with a plurality of posts, each of said posts being provided with a through hole, said other main frame being provided with a dowel hole for receiving said post when said main frames are attached together, the bottom side of said dowel hole being provided with threaded hole for receiving a screw to fix said main frames with each other;

a swivel hook having an enlarged boss being retained in the larger space of said hole;

a pair of shoulder members which have an identical configuration with each other and being attached to said main frames, said shoulder member having an "I" shape cross section, upper and lower plates and being slidable within said sliding slots of said main frames, a connecting plate being interconnected between the upper and lower plates, a guiding hole being disposed at the central portion of said connecting plate, a stopper being disposed at the inner side of said guiding hole, two connecting holes being provided at said connecting plate, the side of said shoulder member being connected with a side shoulder which extends downward and outward, a connecting hole being disposed at the bottom end of said side shoulder, said connecting hole having a rectangular slot at the middle portion, a retaining portion being provided at the side of said rectangular slot;

a gear being disposed between said main frames by means of a shaft which is rotably bridged between said central holes, said shaft having a passage lengthwise, a key slot being provided at said passage, a positioning tab being provided at its peripheral;

a pair of adjusting knobs which have an identical configuration with each other being disposed at said main frames, the shaft of the adjusting knobs having a rectangular key having a hooker at a front portion, said shaft of said knob being received and retained within said passage of said shaft of said gear;

a pair of racks which have an identical configuration being meshed with said gear at upper and lower sides, one end of each of said racks having a connecting block which can be received and retained within said connecting holes of said shoulder members, each of said racks being slidably disposed within two adjacent slots;

a pair of crossbars which have an identical configuration being bridged between said shoulder members, each of said crossbars being defined by a rod which has a flat arc cross section, when said crossbars are jointed together, a rod is formed, the end of said crossbars being provided with a hooker respectively, the inner underside of said crossbar being formed with a retaining hooker to be received and retained by the retaining portion of said connecting hole;

a tube being used to enclose said crossbars.

2. A suit hanger as recited in claim 1, wherein said rack is made from nylon.

* * * * *